US005266189A

United States Patent [19]

Joseph et al.

[11] Patent Number: 5,266,189

[45] Date of Patent: Nov. 30, 1993

[54] INTEGRATED LOW SEVERITY ALCOHOL-BASE COAL LIQUEFACTION PROCESS

[75] Inventors: Joseph T. Joseph, DuPage County; Marc G. Davidson; Joseph D. Fox, both of Will County, all of Ill.

[73] Assignee: Amoco Corporation

[21] Appl. No.: 877,466

[22] Filed: May 1, 1992

Related U.S. Application Data

[63] Continuation-in-part of Ser. No. 689,192, Apr. 22, 1991, Pat. No. 5,228,982.

[51] Int. Cl.[5] ..... C10G 1/06

[52] U.S. Cl. ..... 208/400; 208/403; 208/415; 208/419; 208/428; 44/620

[58] Field of Search ..... 208/400, 403, 419, 428, 208/415

[56] References Cited

U.S. PATENT DOCUMENTS

| | | | |
|---|---|---|---|
| 3,791,956 | 2/1974 | Gorin et al. | 208/8 |
| 4,094,765 | 6/1978 | Bearden, Jr. et al. | 208/8 |
| 4,149,959 | 4/1979 | Bearden, Jr. et al. | 208/8 |
| 4,332,668 | 6/1982 | Brunson | 208/8 |
| 4,401,550 | 8/1983 | Urban | 208/403 |

OTHER PUBLICATIONS

"Extraction of Coal through Dilute Alkaline Hydrolytic Treatment at Low Temperature and Atmospheric Pressure", by D. K. Sharma and S. K. Singh, *Fuel Processing Technology*, vol. 19 (1988) pp. 73–94.

*Primary Examiner*—Theodore Morris
*Assistant Examiner*—P. L. Hailey
*Attorney, Agent, or Firm*—Scott P. McDonald; Richard A. Kretchmer

[57] ABSTRACT

An improved, low severity coal liquefaction process is disclosed. In accordance with the process, coal is first decarboxylated and demineralized with hot sulfurous acid. The decarboxylated coal is then liquefied in the presence of an alcohol and an alkali metal hydroxide. In several embodiments, alkali metal-containing materials are reclaimed to produce alkali metal hydroxide for the liquefaction step. In other embodiments, the liquefaction is conducted in the presence of a relatively high-boiling diluent such as a coal-derived liquid.

18 Claims, 1 Drawing Sheet

INTEGRATED LOW SEVERITY ALCOHOL-BASE COAL LIQUEFACTION PROCESS

This application is a continuation-in-part of U.S. Ser. No. 07/689,192, filed Apr. 22, 1991 and titled "Liquefaction of Decarboxylated Carbonaceous Solids", now U.S. Pat. No. 5,228,982.

FIELD OF THE INVENTION

The invention generally relates to coal liquefaction processes. The invention particularly relates to an integrated, low severity coal liquefaction process in which feed coal is decarboxylated in the presence of sulfurous acid prior to undergoing liquefaction in the presence of an alkali metal hydroxide and an alcohol having 1 to 4 carbon atoms.

BACKGROUND OF THE INVENTION

The presence of vast world-wide deposits of low-ranked coals continues to create interest in processes for coal liquefaction. Because low-ranked coal-derived liquids must compete in the marketplace against other, more easily obtained liquid petroleum products, energy producers continue to search for integrated low-cost liquefaction processes which can provide competitively-priced liquid fuels.

Many schemes for converting coal to hydrogen-rich liquids require hydrogenation in the presence of 2000 to 3000 psig of hydrogen gas, often in ebullated, supported-catalyst hydrotreating reactors. These schemes frequently are not favored because they require relatively high capital and operating expenditures.

One way to reduce the cost of coal-derived liquids is to conduct the liquefaction process at relatively low operating temperatures and pressures and in the presence of a hydrogen donor other than high pressure hydrogen. These processes often can be conducted in relatively inexpensive, low pressure stirred or mixed reactors rather than the ebullated bed reactors typically employed in high pressure hydrogen liquefaction processes. One liquefaction reaction suitable for use in such processes is reacting crushed coal in the presence of an alkali metal base, an alcohol and a catalyst to liquefy the coal and to hydrogenate, and in some cases alkylate, the coal-derived liquids. Laboratory explorations of these processes have been disclosed by Mondragon et al. in Fuel, Vol. 61, November 1982, pages 1131–1134; Vol. 63, May 1984, pages 579–585; and Vol. 64, June 1985, pages 767–771, and by Ozaki et al. in Fuel Processing Technology, Vol. 14, pages 145–153 (1986).

Other workers have disclosed the solubilization of coal in methanol and sodium hydroxide in the absence of a dissolution catalyst. For example, in Koks, Smole, Gaz 31(2) 23–6 (1986), Salbut et al. disclosed a process in which coal pre-extracted by a benzene/ethanol mixture was liquefied in methanol and sodium hydroxide at about 325 degrees Centigrade.

Other workers have attempted to enhance the alcohol/base liquefaction of coal by providing a coal pre-treatment step. For example, in Fuel Processing Technology, Vol. 19, pages 287–292 (1988), Salbut et al. disclosed a process in which a performic acid oxidation step precedes a methanol/sodium hydroxide liquefaction step. Salbut noted that in each example therein, the oxidized coal produced a lower liquefaction yield and contained an increased number of carboxyl and hydroxyl groups which had to be eliminated by subsequent hydrogenation.

Both Salbut's reduced liquefaction yield and increased hydrogenation requirements suggest that performic acid pre-treatment is not an optimal pre-treatment step for alcohol/base liquefaction processes. Salbut's process also is not preferred because the high levels of carbonyl groups present in the pretreated coal increase the conversion of sodium hydroxide to less effective liquefaction agents such as sodium carbonate and sodium bicarbonate. Finally, because Salbut's process appears to oxidize minerals present in the coal to highly oxidized water-insoluble compounds, his pretreatment is not well suited to recovering solid pretreated coal apart from insoluble minerals which, if not separated from the coal, can hinder the effectiveness of downstream process steps such as reagent reclamation.

Other coal pre-treatment schemes such as those disclosed in U.S. Pat. No. 4,161,440 pre-treat coal with a sulfur oxide to form insoluble mineral salts that remain stable during liquefaction. In similar processes like those disclosed in U.S. Pat. No. 4,304,655, an oxidizing agent such as oxygen is added during the pretreatment step. While the insoluble salts formed by these pre-treatment steps may reduce reactor scaling under high pressure hydrogen liquefaction conditions, these processes are not preferred for use with a base/alcohol liquefaction process because oxidation of the coal produces additional carbonyl groups in the coal. These additional carbonyl groups can hinder the liquefaction process because they can convert the alkali metal hydroxide liquefaction reagent to less effective carbonate and bicarbonate forms. These processes also are not preferred because they introduce insoluble mineral matter into the liquefaction reactor, thereby potentially interfering with the reclamation of alkali metal meterial removed from the reactor.

Thus, a need exists for an improved low severity alcohol/base liquefaction process having a coal pretreatment step which can reduce the carboxyl content of the coal prior to the liquefaction step. The process preferably should provide for high product yields and product quality while at the same time facilitating the reclamation of unconsumed or reclaimable base and alcohol liquefaction reagents.

Our commonly assigned U.S. application Ser. No. 07/689,192 discloses a coal liquefaction process in which coal undergoes an initial decarboxylation step in the presence of hot, liquid water and sulfurous acid. It has now been found that this hot sulfurous acid pretreatment step provides unexpected advantages when used as part of an integrated alcohol/base liquefaction process.

SUMMARY OF THE INVENTION

It is an object of the present invention to provide an improved low-severity coal liquefaction process.

It is a further object of the invention to provide an integrated, low severity coal liquefaction process in which coal is decarboxylated prior to an alcohol/alkali metal hydroxide liquefaction, thereby enhancing the effectiveness of the liquefaction reaction by minimizing the conversion of alkali metal hydroxide to alkali metal carbonates and bicarbonates during the liquefaction.

It is another object of the invention to provide an integrated, low severity coal liquefaction process in which coal is simultaneously demineralized and decarboxylated by hot sulfurous acid prior to an alcohol/alkali metal hydroxide liquefaction, thereby allowing decarboxylated coal to be easily separated from coal-derived minerals prior to the liquefaction.

Other objects of the invention will be apparent as discussed herein.

The foregoing objects of the invention can be accomplished by a low severity liquefaction process comprising the steps of reacting a solid carbonaceous material and sulfurous acid under decarboxylation conditions to decarboxylate the solid material and dissolve minerals present in the solid material; and liquefying the decarboxylated solid under liquefaction conditions in the presence of at least one alkali metal hydroxide and at least one alcohol having one to four carbon atoms to produce a hydrocarbon-containing liquid.

Employing a hot sulfurous acid pretreatment step substantially reduces the carboxyl content of the coal, thereby minimizing the conversion of the alkal metal hydroxide liquefaction reagent to alkali metal carbonate and bicarbonate forms during liquefaction.

The use of the hot sulfurous acid pretreatment step also causes coal-derived minerals to remain in water-soluble forms, thereby providing for simple separation of decarboxylated coal from the minerals prior to liquefaction. Removing minerals from the coal prior to the liquefaction step maximizes reclamation of alkali metal compounds from the liquefaction step as it minimizes the formation of non-regenerable alkali metal compounds such as alkali metal silicates.

DETAILED DESCRIPTION OF THE INVENTION

Figure 1:
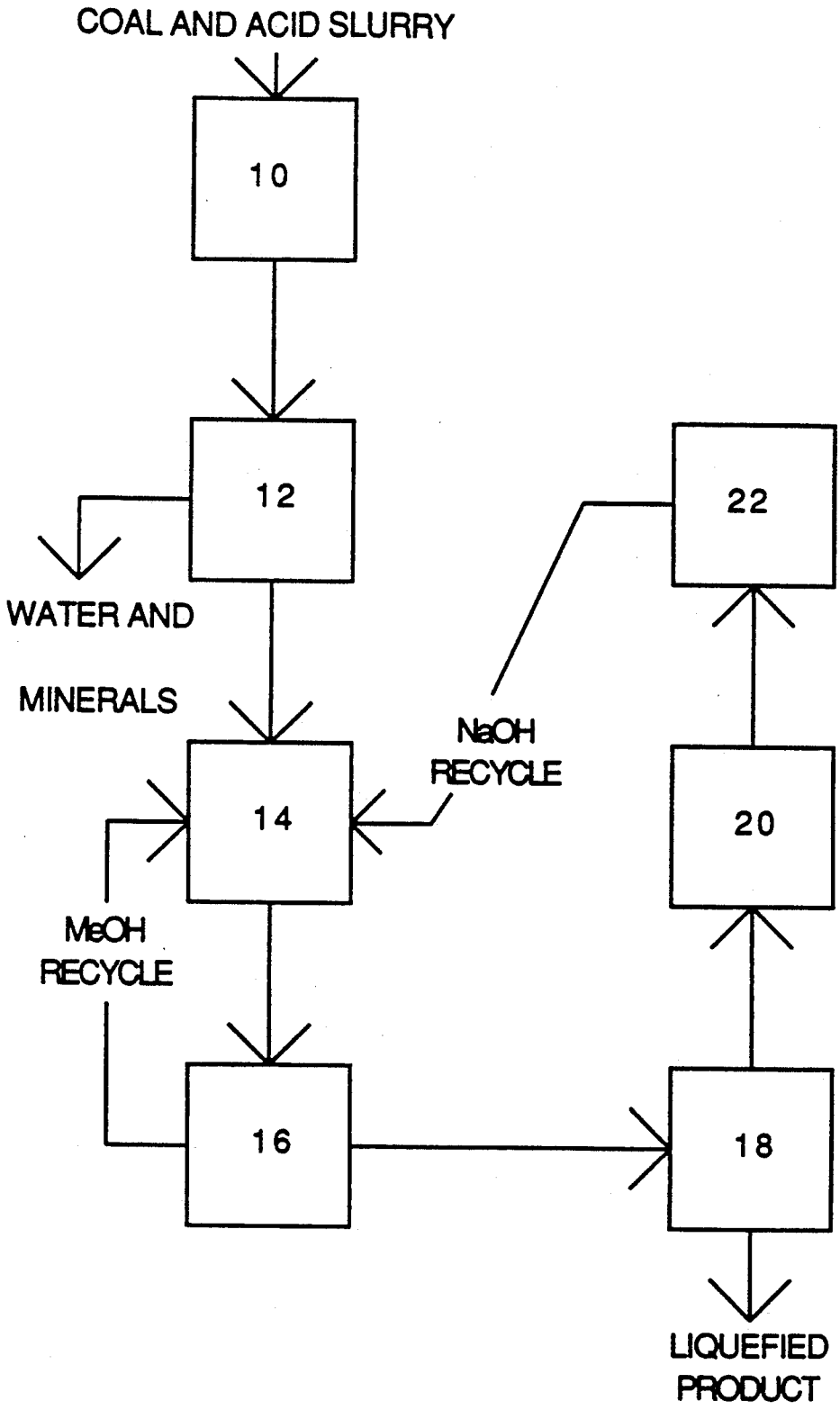
FIG. 1 is a process flow diagram of an integrated low severity liquefaction process in accordance with the present invention.

In the present invention, a carboxylated, carbonaceous solid feedstock such as a low-ranked coal is first demineralized and decarboxylated in the presence of sulfurous acid under decarboxylation conditions. The decarboxylated feedstock is then reacted with a $C_1$ to $C_4$ alcohol and an alkali metal hydroxide under liquefaction conditions to produce an upgraded, coal-derived liquid product. In preferred embodiments of the invention, the alkali metal compounds are reclaimed from the liquefied mixture and regenerated to provide fresh alkali earth hydroxide liquefaction reagent.

Solid carbonaceous feedstocks suitable for use in the invention include coals, tar sands and oil shales. The preferred feedstocks are highly carboxylated low-ranked coals such as brown coal, lignite, peat or subbituminous coals. In the following descriptions of the invention, all suitable feedstocks are referred to as coal.

Decarboxylation conditions suitable for conducting the sulfurous acid decarboxylation and demineralization include temperatures ranging from about 200 to 375 degrees Centigrade and pressures ranging from about 300 to 1000 psig for residence times of about 10 minutes to 2 hours. The sulfurous acid used in this step can be provided as an aqueous solution. Alternatively, the acid may be formed by bubbling a stoichiometrically sufficient quantity of sulfur dioxide through water or a coal/water slurry as explained below.

Liquefaction conditions suitable for liquefying the decarboxylated coal include temperatures ranging from 200 to 375 degrees Centigrade, preferably from 275 to 325 degrees Centigrade, and pressures of from 0 to 1500 psig, preferably from 600 to 1000 psig.

The base and alcohol used in the liquefaction step preferably are recycled process-derived materials. Any alkali metal hydroxide base such as sodium or potassium hydroxide may be used in the liquefaction reaction, although sodium hydroxide is preferred as it is relatively inexpensive. Any alcohol having 1 to 4 carbon atoms can be used in the liquefaction including methanol, ethanol, normal or iso- propanol, or normal, iso-, sec- or tertbutanol. Methanol is preferred because it both alkylates and hydrogenates the coal-derived liquids and is relatively inexpensive.

Between about 0.1 and 1 parts by weight of base should be used for each part by weight of coal, with at least about 0.75 parts by weight required for 100 percent coal conversion. The alkali metal hydroxide preferably is provided as an aqueous solution containing between 0.1 and 3 parts of water per part of alkali metal hydroxide. Alcohol loadings should be between about 1 and 10 parts by weight per part by weight of coal, with the lighter alcohol loadings up to about 3 parts being preferred as these loadings minimize the formation of hydrogen gas.

In some embodiments, the liquefaction may be carried out in the presence of a high boiling diluent such as a coal-derived liquid or other hydrocarbonaceous liquid or mixture of liquids having an initial boiling point at least 50 degrees and preferable at least 150 degrees Centigrade higher than the boiling point of the alcohol liquefaction reagent. The presence of this diluent provides for efficient liquefaction at relatively low alcohol loadings and liquefaction pressures. The presence of the diluent also provides for substantially complete coal conversion at relatively low methanol loadings of about 1 part alcohol per part by weight of coal.

The preferred liquefaction reagents for practicing the invention are methanol and sodium hydroxide. A representative process for practicing this embodiment of the invention is illustrated in FIG. 1. This integrated process reclaims methanol and sodium hydroxide for reuse and employs a high-boiling coal-derived diluent in the liquefaction step to reduce the liquefaction pressure and methanol concentration required for satisfactory conversion of the coal to coal-derived liquids.

In this embodiment, a low-ranked coal crushed to an 8 minus mesh is first decarboxylated and demineralized within a decarboxylation vessel 10 in the presence of a heated solution of sulfurous acid. In this pre-treatment step, the hot, liquid water causes the coal to be decarboxylated while the sulfurous acid causes minerals containing alkali and alkaline earth metals present in the coal to be converted to water-soluble bisulfite salts. Sulfurous acid demineralization is employed because simple sink-float or other density-based separations cannot effectively remove the alkali and alkali earth metal cations which are associated with carboxyl groups as part of the organic coal matrix.

Sulfurous acid is a preferred demineralization acid both because it is relatively inexpensive and because it forms soluble bisulfites of alkali and alkaline earth metals. These bisulfites can be easily removed by aqueous wash. Other acids such as halogen acids are not recommended because they can corrode system components. Sulfuric acid is not recommended because it forms insoluble salts of calcium and barium which typically cannot be removed from the decarboxylated solid coal by an aqueous wash. If not removed prior to liquefaction, these insoluble salts eventually will accumulate in the base recycle stream, thereby interfering with base recycling. Most other acids may be unsuitable for one or more of the above reasons.

Coal and a sufficient amount of sulfurous acid preferably enter vessel 10 as a dilute sulfurous acid/coal slurry having a liquid to coal weight ratio of from about 1 to 1 to about 1 to 4, with a weight ratio of 1 to 2 being preferred. Alternatively, the crushed coal can be slurried with water or a water and process-derived liquid mixture, with sulfur dioxide being bubbled through the slurry within vessel 10 to produce the required sulfurous acid. Stoichiometrically sufficient amounts of sulfurous acid or sulfur dioxide are those required to decarboxylate the coal and to react with the five to ten weight percent of alkali and alkaline earth metals typically contained within the coal. Addition of a stoichiometric amount of sulfurous acid or sulfur dioxide is preferred as this will prevent carboxylic groups from propagating through the process to the liquefaction step, where the carboxyl groups can convert sodium hydroxide liquefaction reagent to liquefaction-inefficient carbonates and bicarbonates. Addition of excess amounts of sulfurous acid or sulfur dioxide can result in excess sulfur oxides carrying over into the liquefaction step and irreversibly combining with sodium, thereby hindering the subsequent reclamation of sodium hydroxide as explained below.

The decarboxylation pre-treatment step should be carried out under decarboxylation conditions which include temperatures from 200 to 375 degrees Centigrade, preferably between 275 and 325 degrees Centigrade. Decarboxylation pressures should range from between about 300 and 1000 psig and preferably as low as possible within this range. Decarboxylation residence times should be between 10 and 75 minutes. It should be noted that while decarboxylation of the coal can be accomplished without the use of sulfurous acid, such a process is incompatible with the present invention as failure to employ an acid demineralization of a low-ranked coal will ultimately cause minerals to complex with sodium in the liquefaction step, thereby hindering reclamation of sodium hydroxide. The use of an oxidizing sulfuroxide treatment step also should be avoided as the introduction of oxygen into the process stream can further oxidize the coal, thereby diminishing the benefits of decarboxylation.

The acidic aqueous slurry of decarboxylated coal and dissolved minerals produced in vessel 10 is next transferred to a separation unit 12 so that decarboxylated coal can be separated from the water, acid and dissolved mineral salts prior to liquefaction. If carbon dioxide remains dissolved in the slurry, it also can be removed by the separation unit. Processes useful in separation unit 12 include sink-float separation, filtration, centrifugation or sedimentation. The choice of separation process is non-critical as long as the process separates the mineral-containing water from the decarboxylated coal, thereby ensuring that the dissolved minerals are not present during the liquefaction and sodium hydroxide reclamation. It is preferred that a density-based separation such as sink-float separation or centrifugation be used as this type of separation also will separate heavy, silica-containing clay-like minerals from the decarboxylated coal.

Decarboxylated coal from separation unit 12 is next transferred to liquefaction reactor 14 for liquefaction, hydrogenation and alkylation. In reactor 14, the decarboxylated coal is liquefied and upgraded under liquefaction conditions in the presence of methanol and sodium hydroxide. Liquefaction conditions suitable for the low severity liquefaction of decarboxylated coal include temperatures ranging from about 200 to 375 degrees Centigrade, preferably from 275 to 325 degrees Centigrade, and pressures of from about 300 to 1000 psig, preferably from 0 to 6 psig. Bench-scale experiments with non-pretreated coal have shown that increasing operating temperature will increase methanol partial pressure within the system and will cause a slight increase in hydrogen to carbon ratio in the liquefied product. The preferred operating temperature, therefore, should be chosen to fully utilize but not exceed the pressure capabilities of the reactor. These same experiments also have shown that relative product molecular weights as measured by vapor phase osmometry decrease slightly as temperature increases within the operating range.

Methanol and sodium hydroxide used in the methanol liquefaction step preferably are recycled process-derived materials. Between about 0.1 and 1 parts by weight of sodium hydroxide should be used for each part by weight of coal, with about 0.75 parts by weight required for 100 percent coal conversion to tetrahydrofuran-soluble material. The sodium hydroxide preferably is supplied to reactor 14 as an aqueous solution containing between 0.1 and 3 parts of water per part of sodium hydroxide. Methanol loadings should be between about 1 and 10 parts by weight per part by weight of coal, with the lighter methanol loadings being preferred as these loadings minimize the formation of hydrogen gas. Total methanol consumption typically runs about 25 weight percent of the coal charge.

The liquefaction preferably is conducted in the presence of a high boiling diluent such as a coal-derived liquid having an initial boiling point at least 50 degrees Centigrade higher than that of methanol, with boiling point differences of at least 150 degrees being preferred. The use of a diluent is preferred because methanol remains dissolved in the diluent at temperatures greater than the boiling point of methanol, thereby enhancing the contact between the methanol and the coal. Because the contact between coal and methanol is enhanced, the reaction can proceed at lower methanol loadings that yield lower methanol partial pressures, thereby reducing vessel pressure requirements. Examples 17–19, below, illustrate the effect of a relatively high-boiling diluent on reactor pressure. The relationship illustrated by those Examples is believed to apply to coals decarboxylated in accordance with the present invention.

Liquefied product withdrawn from reactor 14 is next passed through a 100 degree Centigrade atmospheric pressure flash evaporator 16 to remove methanol and water from the reactor 14 effluent. The methanol and water evaporator overheads can be recycled directly to liquefaction reactor 14, but preferably are processed to remove as many impurities from the recycled methanol as possible prior to the reintroduction of the methanol into reactor 14. Laboratory studies with non-pretreated coal liquefied at 300 degrees Centigrade suggest that about 75 percent of the methanol added to liquefaction reactor 14 will remain unreacted and therefore available for recycle, with about 5 percent being converted to hydrogen, 5 percent being consumed in hydrogenation reactions, and up to 17 percent being adducted to coal as methyl groups.

The dewatered effluent from evaporator 16 next enters fractionation unit 18. Fractionation unit 18 can employ any of several types of fractionating processes known in the art. Coal-derived liquids fractionated by unit 18 can be utilized as is or upgraded as desired. If unit 18 is an atmospheric or vacuum distillation tower, the tower bottoms comprise the feedstock for the sodium hydroxide recycle step discussed below. In other embodiments in which fractionating unit 18 is a single or multi-stage critical solvent deashing unit, the solids-containing phase including sodium hydroxide and unconverted coal comprises the feedstock for the sodium hydroxide recycle step. Studies conducted with non-pretreated coal suggest that virtually all the sodium originally present in liquefaction reactor 14 as sodium hydroxide is available for reuse as long as the sodium has not combined with mineral matter to form non-reclaimable compounds such as sodium silicate. This further underscores the need for an effective demineralization step like the hot sulfurous acid step disclosed above as this step significantly reduces the quantity of undesired minerals available to irreversibly combine with sodium within reactor 14.

Residue from fractionating unit 18 next passes to a sodium recycle unit 20 which typically is a high temperature fluid bed combustor. Coke, unburned coal, sodium and other salts are burned in combustor 20 at a temperature of about 1000 to 1500 degrees Centigrade to produce sodium oxide and waste gases. If required for complete combustion, supplemental coal may be added to combustor 20. Sulfur oxide gases produced in combustor 20 should be captured by limestone or similar absorbents, while nitrogen oxides can be treated by recycling these gases to the inlet of the combustor and operating the combustor at reducing conditions to convert nitrogen oxides to nitrogen. Heat produced by combustor 20 preferably is used to generate steam or electrical power required by other process equipment.

Sodium oxide produced in combustor 20 is hydrated in a slaker 22 to produce sodium hydroxide for use in reactor 14. Slaker 22 typically is a stirred tank reactor in which sodium and water are stirred together to form recycled sodium hydroxide. Slaker 22 preferably includes a series of hydroclones for removing undissolved mineral matter from slaker 22 effluent prior to the recycled sodium hydroxide being returned to reactor 14.

While methanol is the preferred hydrogen donor for the process just described, ethanol, $C_3$ and $C_4$ alcohols may be used as well. Relative concentrations of reactants and operating conditions for these liquefactions can be identical to those disclosed for the methanol liquefaction. It should be noted, however, that in an ethanol/sodium hydroxide liquefaction step, ethanol will donate only hydrogen while the methanol used in a methanol/sodium hydroxide liquefaction will provide for both hydrogenation and methyl group adduction. Furthermore, recycling of ethanol is difficult as some ethanol is converted to acetic acid during the liquefaction step, which is not inexpensively separated from ethanol. Thus, ethanol is not a preferred liquefaction reagent. Branched $C_3$ and $C_4$ alcohols may be more effective liquefaction reagents than ethanol as it is believed that these alcohols may both alkylate and hydrogenate the coal-derived liquids under the stated liquefaction conditions.

Other reaction conditions within the stated liquefaction ranges can be employed to minimize operating pressure while maintaining product quality. For example, the liquefaction reaction can be performed with little or no water addition and with methanol added at the minimum rate required to maintain the desired coal conversion and product quality. Under these conditions, and at temperatures above the alkali hydroxide melting point, it is believed that the reaction can be conducted in molten alkali hydroxide in the absence of added water.

EXAMPLES

The following examples provide data representative of the efficacy of a two-stage liquefaction process in accordance with the present invention.

EXAMPLE 1

In this example, 10 grams of Black Thunder subbituminous coal having the physical characteristics summarized in Table 1 was pulverized to pass through a 320 mesh screen. The pulverized coal was reacted in a 0.3 liter batch autoclave reactor at 300 degrees Centigrade for one half hour in the presence of 30 grams of a two percent aqueous solution of sulfur dioxide.

Analysis of the treated product showed that the treated product contained 73.3 weight percent carbon, 4,6 percent hydrogen, and 16.0 percent oxygen, resulting in a calculated hydrogen to carbon atomic ratio of 0.75. The mineral content of the treated coal was reduced from 6.6 percent to 3.6 percent, and comparison of infra-red absorption bands in the carbonyl range indicated that the relative abundance of carbonyl groups in the treated coal was about half that of the starting coal.

EXAMPLE 2

The treated coal from Example 1 was separated from the aqueous phase produced in Example 1 and returned to the 0.3 liter batch autoclave reactor along with 10 grams methanol, 10 grams of water, 20 grams of 1-methylnaphthalene diluent and 7.5 grams of sodium hydroxide. The reactor was inerted with nitrogen at ambient pressure and then heated to 300 degrees Centigrade for 1 hour.

The reaction yielded 98.5 percent THF-soluble products relative to the dry ash-free weight of the starting coal. The THF-soluble products contained 80.0 percent carbon, 6.6 percent hydrogen, and 7.6 percent oxygen, resulting in a calculated hydrogen to carbon atomic ratio of 0.97.

Examples 1 and 2 illustrate that the integrated hot sulforous acid pretreatment and methanol/sodium hydroxide liquefaction process produced a 98 percent yield of a product while improving the hydrogen to carbon atomic ratio from 0.84 in the starting coal to 0.97 in the upgraded liquid product. Nuclear magnetic resonance studies of products produced from non-pretreated coals suggest that most product quality improvement results from the methylation of aliphatic coal liquefaction products by the methanol. This is particularly advantageous if subsequent product upgrading is required, as liquefaction products methylated at these locations are expected to retain their methyl groups during subsequent upgrading better than products methylated at oxygen or aromatic locations.

TABLE 1

| | Starting Coal (dry weight percent) | Example 1 Product (weight percent) | Example 2 Product (weight percent) |
|---|---|---|---|
| C | 72.0 | 73.3 | 80.0 |
| H | 5.1 | 4.6 | 6.6 |
| O | 20.0 | 16.0 | 7.6 |
| N | 1.1 | 1.2 | 0.5 |
| S | 1.0 | 1.9 | 0.2 |
| Minerals (total) | 6.6 | 3.6 | 0 |
| H:C ratio | 0.84 | 0.75 | 0.97 |

The following examples illustrate the relative effects of altering certain operating parameters in a sodium hydroxide and methanol coal liquefaction step. While the coal used in each of these examples was not pre-treated with hot sulfurous acid, the relationships illustrated in these examples are believed to represent those obtainable with coals pre-treated in accordance with the present invention.

EXAMPLES 3-9

To determine the effects of sodium hydroxide loading on coal conversion, 10 grams of Wyodak sub-bituminous coal having 72.0 percent carbon, 5.1 percent hydrogen, 1.1 percent nitrogen, 1.0 percent sulfur and 20.1 percent oxygen (dry ash-free basis) was pulverized to pass through a 320 mesh screen. In Example 3, 10 grams of coal, 30 grams of methanol and 10 weight percent of sodium hydroxide (relative to the coal) was stirred together and placed in a 300 cc pyrex-lined batch autoclave reactor equipped with a magnetic stirring device. The reactor was then purged with nitrogen and pressurized to no more than 300 psig. Next, the reactor was heated to 300 degrees Centigrade for a period of 1 hour and coal conversion as measured by THF-soluble products determined. In Examples 4-9, 30, 40, 50, 60, 80 or 100 weight percent of sodium hydroxide (relative to the coal) was reacted under conditions identical to those of Example 3 and the conversion to THF-soluble products determined.

As can be seen by comparing the data summarized in Table 2, coal conversion linearly increased with increasing sodium hydroxide loading, reaching 100 percent conversion at a loading of about 75 weight percent sodium hydroxide. These results suggest that 75-80 weight percent sodium hydroxide loading is a preferred maximum loading as higher loadings do not increase conversion.

TABLE 2

| Example | NaOH Loading (weight percent coal) | Conversion to THF Solubles (%) |
|---|---|---|
| 3 | 10 | 21 |
| 4 | 30 | 41 |
| 5 | 40 | 66 |
| 6 | 50 | 64 |
| 7 | 60 | 93 |
| 8 | 80 | 100 |
| 9 | 100 | 100 |

EXAMPLES 10-14

Examples 10-14 illustrate the effects of methanol loading on coal conversion. In Example 10, 10 grams of coal, 3 grams of water, and 60 weight percent of sodium hydroxide was reacted under the conditions of Example 3 in the presence of 1000 weight percent (relative to coal) of methanol. As before, coal conversion was measured by comparing the weight of THF-soluble products to the dry ash-free weight of the starting coal. In Examples 11, 12 and 13, the methanol loadings were reduced to 600, 300 and 100 weight percent, respectively. In Example 14, the methanol loading was 100 percent and 20 grams of 1-methylnaphthalene (200 weight percent relative to the coal) was added to test the effect of a high-boiling diluent on conversion.

The results of Examples 10-14 are summarized in Table 3. These experiments show that in the absence of a high boiling diluent, acceptable liquefaction results can be obtained with methanol loadings down to about 300 percent of the weight of the coal charge. In the presence of a relatively high boiling diluent, acceptable conversion occurs with a methanol loading of 100 weight percent. This result is believed to be attributable to methanol remaining dissolved in the diluent at temperatures above the boiling point of methanol, thereby providing for better contact between the coal and the methanol at these temperatures despite the relatively low temperature loading.

TABLE 3

| Example | Methanol Loading (weight percent of coal) | Diluent Loading (weight percent of coal) | Conversion to THF Solubles (%) |
|---|---|---|---|
| 10 | 1000 | 0 | 94 |
| 11 | 600 | 0 | 99 |
| 12 | 300 | 0 | 100 |
| 13 | 100 | 0 | ND[1] |
| 14 | 100 | 200 | 100 |

[1]None determined due to high level of insolubles.

EXAMPLES 15-19

Examples 15-19 were performed to determine the effect of temperature on reactor pressure in either the absence or presence of a relatively high-boiling diluent. In Examples 15-18, 10 grams of coal, 10 grams of methanol and 7.5 grams of sodium hydroxide were reacted in a 300 cc autoclave reactor as in Example 3, at temperatures of 250, 260, 300 and 300 degrees Centigrade, respectively. As summarized in Table 4, measured reactor pressures ranged from 400 to 1250 psig. Substantially complete conversion was obtained in each case.

In Example 19, 20 grams of 1-methylnaphthalene was added as a relatively high-boiling diluent. The reaction was conducted at 300 degrees Centigrade and yielded a reactor pressure of 700 psig. Substantially complete conversion to THF-soluble material was obtained.

Comparing Example 18 to Example 19 illustrates that the methanol liquefaction reaction can be conducted at significantly lower pressures when a high-boiling diluent is employed.

TABLE 4

| Example | Temp (°C.) | Diluent (weight percent) | Pressure (psig) |
|---|---|---|---|
| 15 | 250 | 0 | 400 |
| 16 | 260 | 0 | 600 |
| 17 | 300 | 0 | 1250 |
| 18 | 300 | 0 | 1100 |
| 19 | 300 | 200 | 700 |

The foregoing description and Examples illustrate several embodiments of an improved low severity liquefaction process which combines a hot sulfurous acid decarboxylation/demineralization step with an alcohol-/alkali metal hydroxide liquefaction step. Other embodiments and modifications not departing from the spirit of the invention will be apparent to those skilled in the art after reviewing this disclosure. The scope of the invention, therefore, is intended to be limited only by the following claims.

We claim:

1. A low severity liquefaction process comprising the steps of:

reacting a solid carbonaceous material and sulfurous acid under decarboxylation conditions at a temperature between 200° and 375° C. and at a pressure between 300 and 1000 psi to decarboxylate the solid material and dissolve minerals present in the solid material; and liquefying the decarboxylated solid under liquefaction conditions at a temperature between 200° and 375° C. and at a pressure between 300 and 1000 psi in the presence of at least one alkali metal hydroxide and at least one alcohol having one to four carbon atoms to produce a hydrocarbon-containing liquid.

2. The process of claim 1 wherein at least a portion of any unconsumed alcohol present in the hydrocarbon-containing liquid is reclaimed from the hydrocarbon-containing liquid.

3. The process of claim 1 wherein at least a portion of any alkali metal compounds present in the hydrocarbon containing liquid are reclaimed from the hydrocarbon-containing liquid.

4. The process of claim 1 wherein the liquefying step is conducted in the presence of a diluent having a boiling point at least 50 degrees Centigrade higher than the alcohol used in the liquefying step.

5. The process of claim 1 wherein the alcohol is methanol and the alkali metal hydroxide is sodium hydroxide.

6. The process of claim 5 wherein the diluent is a process-derived hydrocarbon-containing liquid having an initial boiling point greater than about 150 degrees Centigrade at atmospheric pressure.

7. A low severity coal liquefaction process comprising the steps of:

reacting coal and sulfurous acid under decarboxylation conditions at a temperature between 200° and 375° C. and at a pressure between 300 and 1000 psi to decarboxylate and demineralize the coal;

recovering the decarboxylated, demineralized coal from a solution containing dissolved coal minerals; and liquefying the decarboxylated coal in the presence of methanol and sodium hydroxide under liquefaction conditions at a temperature between 200° and 375° C. and at a pressure between 300 and 1000 psi to produce a coal-drived liquid.

8. The process of claim 7 further comprising the steps of:

separating a substantially sodium-containing phase from the coal-derived liquid;

heating the sodium-containing phase to burn any carbonaceous material contained therein and to convert sodium-containing compounds contained therein to sodium oxide;

leaching the sodium oxide with water to produce heat and sodium hydroxide; and using the sodium hydroxide produced in the leaching step as a reactant in the liquefying step.

9. The process of claim 8 wherein heat is recovered from the leaching step and used to heat the solid, the alkali metal hydroxide and the alcohol during the liquefying step.

10. The process of claim 7 wherein methanol is separated from the coal-derived liquid.

11. The process of claim 7 wherein the liquefaction step is conducted in the presence of a coal-derived diluent having an initial boiling point above about 150 degrees Centigrade at atmospheric pressure.

12. The process of claim 11 wherein the weight ratio of methanol to diluent is between 1 to 2 and 4 to 2.

13. The process of claim 7 wherein the weight ratio of sodium hydroxide to coal in the liquefaction step is between 1 to 2 and 3 to 2.

14. The process of claim 7 wherein the weight ratio of methanol to coal in the liquefaction step is between 1 to 1 and 3 to 1.

15. A low severity coal liquefaction process comprising the steps of:

reacting coal and sulfurous acid under decarboxylation conditions at a temperature between 200° and 375° C. and at a pressure between 300 and 1000 psi to decarboxylate and demineralize the coal;

separating the decarboxylated, demineralized coal from soluble minerals derived from the coal;

liquefying one part by weight of the decarboxylated coal in the presence of at least 1 part by weight of methanol and 0.75 parts by weight of sodium hydroxide under liquefaction conditions at a temperature between 200° and 375° and at a pressure between 300 and 1000 psi to produce a methanol-containing coal-derived liquid;

separating methanol from the coal-derived liquid;

reusing the separated methanol as a reactant in the liquefying step;

separating a sodium-containing sludge from the coal derived-liquid;

heating the sludge to burn carbonaceous material contained therein and to convert sodium-containing compounds contained therein to sodium oxide;

leaching the sodium oxide with water to produce heat and recycled sodium hydroxide; and using the recycled sodium hydroxide as a reactant in the liquefying step.

16. The process of claim 15 wherein the liquefaction step is conducted in the presence of at least 0.5 parts by weight per part of coal of a process-derived diluent having an initial boiling point above about 150 degrees Centigrade at atmospheric pressure.

17. The process of claim 16 wherein the liquefaction step is conducted in the presence of between about 1 and 3 parts by weight of methanol per part of coal and at a temperature between 250 and 350 degrees Centigrade.

18. The process of claim 15 wherein the heat recovered from the leaching step is used to heat the solid, the alkali metal hydroxide and the alcohol in the liquefying step.

* * * * *